US011368772B2

(12) United States Patent
Tsubone

(10) Patent No.: US 11,368,772 B2
(45) Date of Patent: Jun. 21, 2022

(54) HEADPHONE AND EARMUFF

(71) Applicant: Audio-Technica Corporation, Tokyo (JP)

(72) Inventor: Kodai Tsubone, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 17/018,195

(22) Filed: Sep. 11, 2020

(65) Prior Publication Data

US 2021/0084400 A1 Mar. 18, 2021

(30) Foreign Application Priority Data

Sep. 13, 2019 (JP) ..... JP2019-166745

(51) Int. Cl.
*H04R 25/00* (2006.01)
*H04R 1/10* (2006.01)
*H04R 5/033* (2006.01)

(52) U.S. Cl.
CPC ..... *H04R 1/1008* (2013.01); *H04R 1/1066* (2013.01); *H04R 5/0335* (2013.01)

(58) Field of Classification Search
CPC ... H04R 1/1008; H04R 1/1066; H04R 5/0335
USPC ..... 381/370
See application file for complete search history.

(56) References Cited

U.S. PATENT DOCUMENTS 5,469,505 A * 11/1995 Gattey ..... H04M 1/05 379/430
5,497,427 A * 3/1996 Nageno ..... H04R 1/1066 381/381
6,356,644 B1 * 3/2002 Pollak ..... H04R 1/1008 181/129
6,542,615 B1 * 4/2003 Ito ..... H04R 1/1066 381/374
8,000,490 B2 * 8/2011 Yang ..... H04R 1/1075 381/371

(Continued)

FOREIGN PATENT DOCUMENTS

EP 0 589 623 A2 3/1994
EP 1 641 314 A1 3/2006

(Continued)

*Primary Examiner* — Phylesha Dabney
(74) *Attorney, Agent, or Firm* — WCF IP

(57) ABSTRACT

The present invention can easily improve a close contact property between an ear pad and a temporal region at low cost. The headphone 1 comprises a driver unit 11, a baffle member 12 that holds the driver unit, an ear pad 13 that is attached to the baffle member, and a housing 14 that is attached to the baffle member and accommodate the driver unit. The earpads includes a ring-shaped body part 131. The baffle member has a facing surface 121*a* that faces the body part. A direction in which the body part is disposed with respect to the baffle member is the first direction, and a direction in which the housing is disposed with respect to the baffle member is the second direction. At least a part of the facing surface is an inclined part that is inclined to the second direction from the outer edge of the facing surface toward the inner edge of the facing surface or a curved surface that is curved to the second direction from the outer edge of the facing surface toward the inner edge of the facing surface.

21 Claims, 12 Drawing Sheets

(56) References Cited

U.S. PATENT DOCUMENTS

| | | | | |
|---|---|---|---|---|
| 8,130,970 | B2 * | 3/2012 | Heringslack | A61F 11/14 381/71.6 |
| 8,371,417 | B2 * | 2/2013 | Miyazawa | H04R 1/1033 181/129 |
| 9,584,901 | B1 * | 2/2017 | Silvestri | H04R 1/1008 |
| 2013/0195307 | A1 * | 8/2013 | Mizuno | H04R 1/1075 381/374 |
| 2017/0064436 | A1 * | 3/2017 | Tamura | H04R 1/1066 |
| 2017/0366894 | A1 | 12/2017 | Horbach et al. | |
| 2018/0316999 | A1 * | 11/2018 | Bellas | H04R 1/1008 |
| 2021/0084400 | A1 * | 3/2021 | Tsubone | H04R 5/0335 |
| 2021/0260414 | A1 * | 8/2021 | Mundy | A62B 18/006 |

FOREIGN PATENT DOCUMENTS

| | | | |
|---|---|---|---|
| EP | 1 641 614 | A1 | 3/2006 |
| JP | 2009-105841 | A | 5/2009 |
| JP | 2016-225809 | A | 12/2016 |

* cited by examiner

HEADPHONE AND EARMUFF

TECHNICAL FIELD

The present invention relates to a headphone and an earmuff.

BACKGROUND ART

Among headphones, an over-ear type headphone includes a sound emission unit that covers an ear of a user when the headphone is worn by the user. The sound emission unit includes a driver unit, a baffle member and an ear pad. The driver unit outputs sound waves based on electrical signals from the sound source. The baffle member holds the driver unit.

When the headphone is worn by the user, the ear pad is pressed against a temporal region around the user's auricle. At this stage, the ear pad is in close contact with the temporal region and functions as a buffer between the temporal region and the baffle member. As a result, the earpad defines an externally closed acoustic space (closed space) between the user's ear and the driver unit.

Due to individual differences in the shape of the temporal region, a gap easily occurs between the temporal region and the ear pad. When a gap is defined between the ear pad and the temporal region, sound waves from the driver unit leak from the gap to the outside, and the sound pressure in the low frequency range of the headphone is lowered. In addition, the sound insulation of the headphone is reduced, and noise from the outside enters the acoustic space through the gap. Thus, the aforementioned acoustic space is an important element that affects the acoustic characteristics of the headphone. Therefore, when the headphone is worn by the user, the ear pad must be closely attached to the temporal region so as not to define the aforementioned gap (i.e., so as to maintain the airtightness of the acoustic space).

Generally, in order to closely contact the ear pad with the temporal region, an elastic material such as urethane foam, which is easily deformed, is used for the ear pad. When an elastic material with a small elastic modulus is used, the ear pad deforms following the shape of the temporal region and is in close contact with the temporal region. As a result, the airtightness of the acoustic space is maintained, and the wearability (wearing comfort) of the headphone is also improved. However, since the ear pad made of the elastic material with the small elastic modulus is greatly deformed, the volume of the acoustic space is reduced. Further, when an external force is applied to the ear pad, the ear pad is deformed and the headphone is easily displaced. On the other hand, when an elastic material with a high elastic modulus is used, the ear pad is not easily deformed and is incapable of sufficiently following the shape of the temporal region (the ear pad is hard to be in close contact with the temporal region). Consequently, although the volume of the acoustic space can be ensured large, the airtightness of the acoustic space and the wearability of the headphone are reduced.

In order to solve such problem, a technique has been proposed in which a plurality of materials with different elasticity coefficients and hardness are used for an ear pad (see, for example, Japanese Patent Application Publication No. 2016-225809 and Japanese Patent Application Publication No. 2009-105841).

In the technique disclosed in Japanese Patent Application Publication No. 2016-225809, the ear pad includes two ring-shaped elastic materials (first elastic material and second elastic material) with different elastic coefficients. Elastic modulus of the first elastic material is larger than the elastic modulus of the second elastic material. The second elastic material is laminated to the first elastic material such that the second elastic material is disposed closer to the temporal region when the headphone is worn by the user. At least a part of the inner diameter of the second elastic member is configured to be smaller than the inner diameter of the first elastic member. This inner diameter difference causes the space where deformation of the second elastic material is allowed (deformation allowable space) to be defined on the inner peripheral side of the ear pad. When the first elastic material and the second elastic material is wrapped with a cover, the second elastic material is deformed to fall toward the deformation allowable space (inner peripheral side). As a result, an inclined surface inclined toward the inner circumferential side is formed on the surface of the ear pad in contact with the temporal region.

In the technique disclosed in Japanese Patent Application Publication No. 2016-225809, when the headphone is worn by the user, the second elastic member deforms to the inner circumferential side, and the ear pad is in close contact with the temporal region. Then, the first elastic material maintains a predetermined thickness without being deformed. As a result, the airtightness and the volume of the acoustic space are sufficiently ensured.

In the technique disclosed in Japanese Patent Application Publication No. 2009-105841, the ear pad includes three ring-shaped elastic members (an outer annular member, a middle annular member, and an inner annular member) disposed concentrically. The middle annular member is disposed between the outer annular member and the inner annular member. The hardness of the middle annular member is configured to be lower than the hardness of each of the outer annular member and the inner annular member. When these elastic materials are wrapped with the cover, the surface of the ear pad in contact with the temporal region becomes plane due to the tension of the cover and the difference in hardness between the elastic materials.

In the technique disclosed in Japanese Patent Application Publication No. 2009-105841, when the headphone is worn by the user, the outer annular member and the inner annular member bend toward the middle annular member so as to follow the shape of the temporal region, and the ear pad is in close contact with the temporal region. At this stage, each elastic member is not greatly deformed in the thickness direction. As a result, the airtightness of the acoustic space and the volume of the acoustic space are sufficiently ensured.

As described above, in the techniques disclosed in Japanese Patent Application Publication No. 2016-225809 and Japanese Patent Application Publication No. 2009-105841, a plurality of materials with different elastic moduli (hardness) are used for the ear pad to improve the close contact property between the ear pad and the temporal region. As a result, the volume of the acoustic space is ensured, and the airtightness of the acoustic space and the wearability of the headphone are improved. However, these techniques require calculating the deformation amount of each elastic material for each type of headphone to determine a structure of each elastic material. Accordingly, the design of the ear pad is complicated. Further, since a plurality of elastic materials and processing are required for the ear pad, the structure of the ear pad becomes complicated, the cost is increased.

SUMMARY OF INVENTION

Technical Problem

The present invention easily improves close contact property between an ear pad and a temporal region at low cost.

Solution to Problem

The headphone according to the present invention comprises a driver unit; a baffle member that holds the driver unit; an ear pad that is attached to the baffle member; and a housing that is attached to the baffle member to and accommodates the driver unit. The ear pad includes a ring-shaped body part. The baffle member includes a facing surface that faces the body part. A direction in which the body part is disposed with respect to the baffle member is a first direction, and a direction in which the housing is disposed with respect to the baffle member is the second direction. At least a part of the facing surface is an inclined surface that is inclined to the second direction from an outer edge of the facing surface toward an inner edge of the facing surface or a curved surface that is curved to the second direction from an outer edge of the facing surface toward an inner edge of the facing surface.

Advantageous Effects of Invention

According to the present invention, the close contact property between the ear pad and the temporal region can be easily improved at low cost.

DESCRIPTION OF EMBODIMENTS

Embodiments of a headphone according to the present invention will now be described with reference to the attached drawings.

Headphone

Configuration of Headphone

Figure 1:
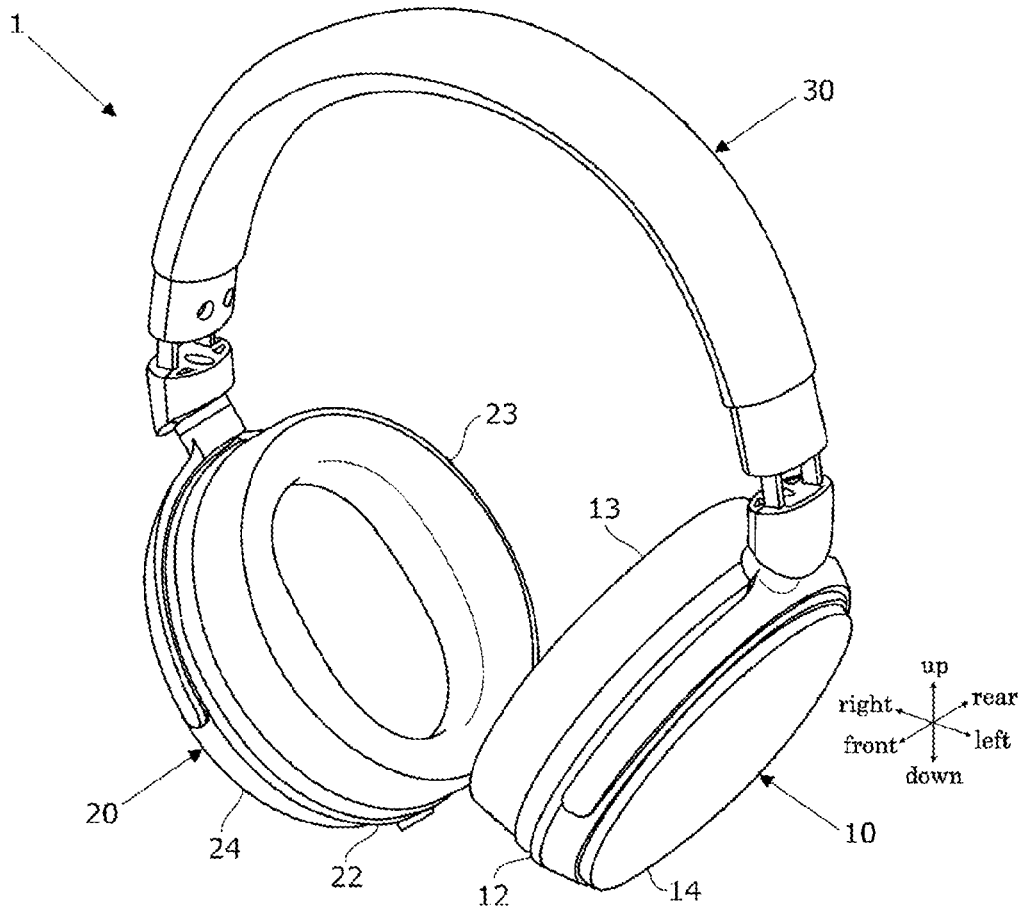
FIG. 1 is a perspective view illustrating an embodiment of a headphone according to the present invention.

FIG. 1 is a perspective view illustrating an embodiment of a headphone according to the present invention.

The headphone 1 is worn on a head of a user of the headphone 1, for example, and outputs a sound wave in accordance with a sound signal from a sound source (not illustrated). The headphone 1 includes a left sound emission unit 10, a right sound emission unit 20, and a connection member 30.

In the following description, the up, down, right, left, front, and rear directions of the headphone 1 correspond to those of the user when the headphone 1 worn on the head of the user (this state is hereinafter referred to as "worn state"). That is, for example, the left sound emission unit 10 is worn on a part around the left ear LE (see FIG. 10; the same applies hereinafter) of the user's temporal region HD (see FIG. 10; the same applies hereinafter), and the right sound emission unit 20 is worn on a part around the right ear (not illustrated; the same applies hereinafter).

In the following description, the "first direction" is a direction in which the temporal region HD is positioned with respect to each of the left sound emission unit 10 and the right sound emission unit 20 in the worn state. That is, the first direction of the left sound emission unit 10 is the right direction of the user, and the first direction of the right sound emission unit 20 is the left direction of the user.

Further, in the following description, the "second direction" is a direction opposite to the first direction. That is, the second direction of the left sound emission unit 10 is the left direction of the user, and the second direction of the right sound emission unit 20 is the right direction of the user.

The left sound emission unit 10 is worn on a part around the left ear LE of the temporal region HD, and outputs sound waves corresponding to sound signals from the sound source.

The right sound emission unit 20 is worn on a part around the right ear of the temporal region HD, and outputs sound waves in accordance with the sound signals from the sound source.

The connection member 30 is connected to the left sound emission unit 10 and the right sound emission unit 20, and supports the left sound emission unit 10 and the right sound emission unit 20. In the worn state, the connection member 30 applies side pressure in the first direction to the left sound emission unit 10 and the right sound emission unit 20 to fix the left sound emission unit 10 and the right sound emission unit 20 to the temporal region HD.

Configuration of Left Sound Emission Unit

Figure 2:
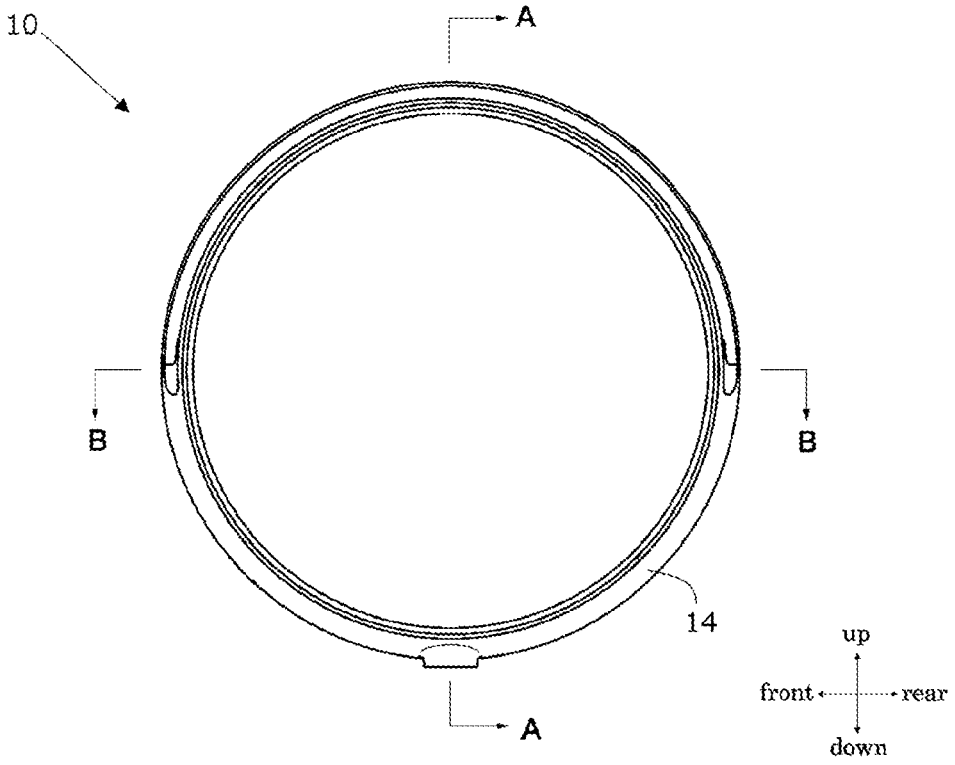
FIG. 2 is a side view of a left sound emission unit included in the headphone in FIG. 1.

FIG. 2 is a side view of the left sound emission unit 10 viewed from the left side of the left sound emission unit 10.

Figure 3:
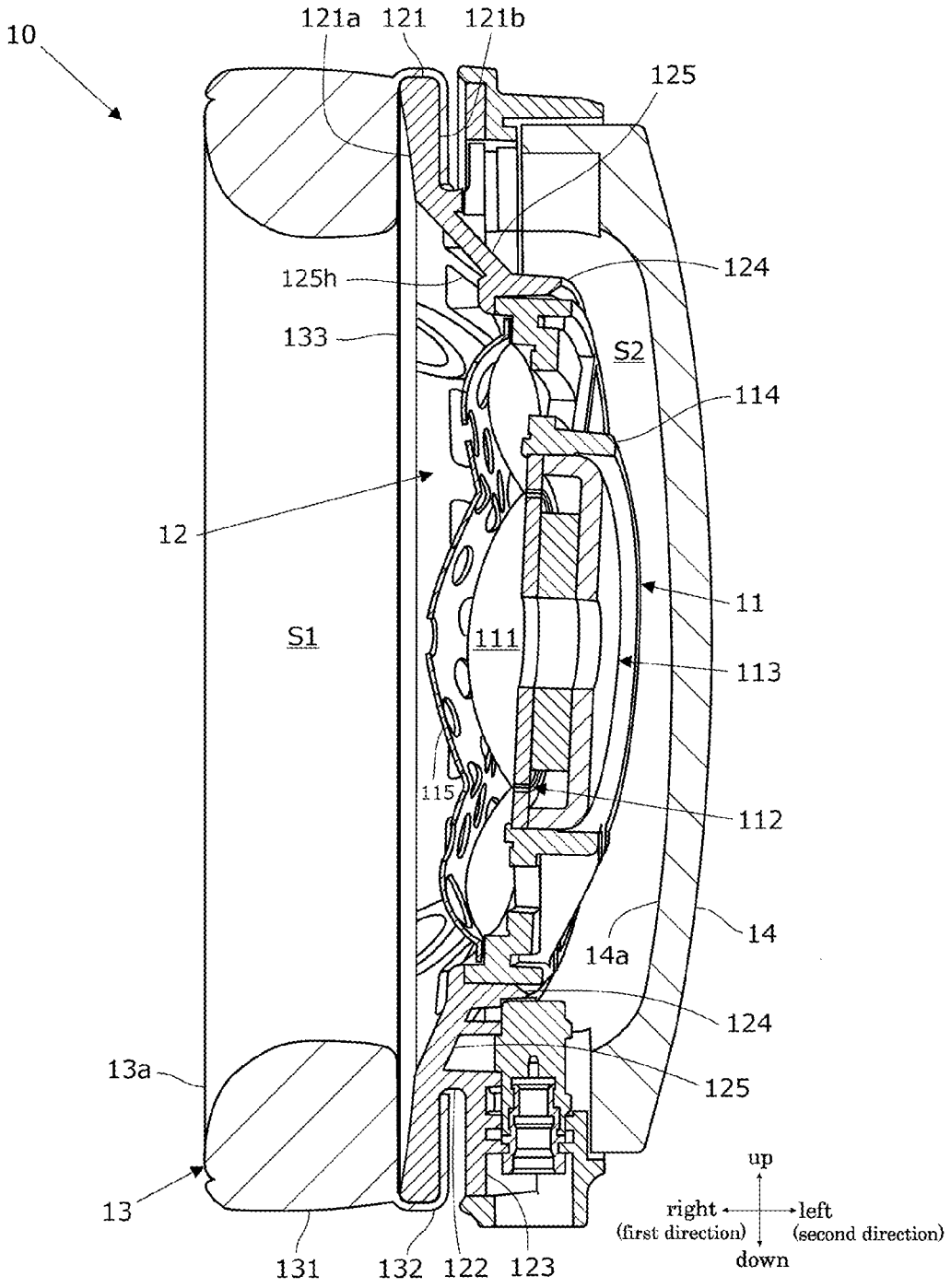
FIG. 3 is a cross-sectional view of the left sound emission unit taken along line A-A in FIG. 2.

FIG. 3 is a sectional view of the left sound emission unit 10 taken along line A-A in FIG. 2.

Figure 4:
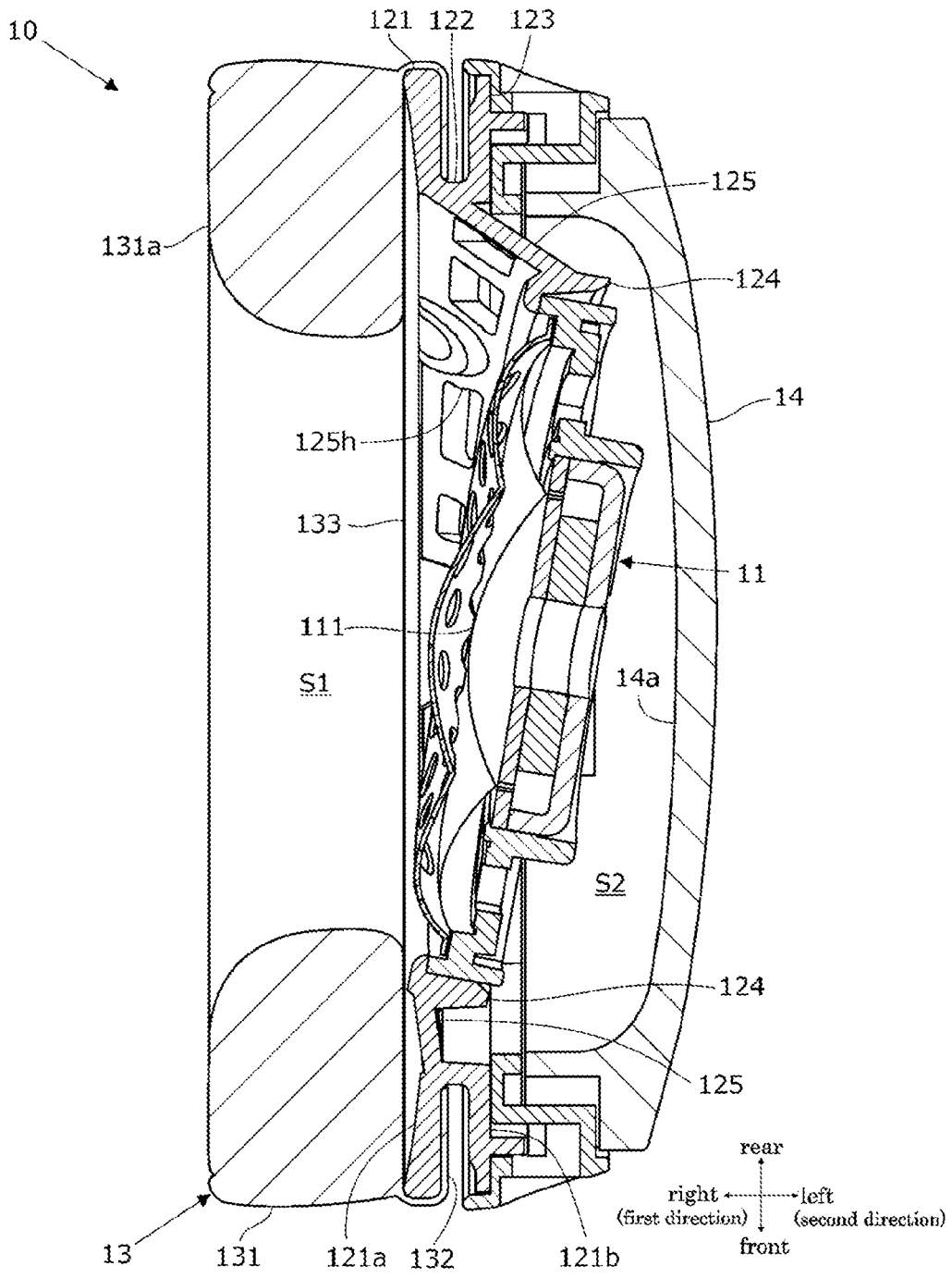
FIG. 4 is a cross-sectional view of the left sound emission unit taken along line B-B in FIG. 2.

FIG. 4 is a cross-sectional view of the left sound emission unit 10 taken along line B-B in FIG. 2.

Figure 5:
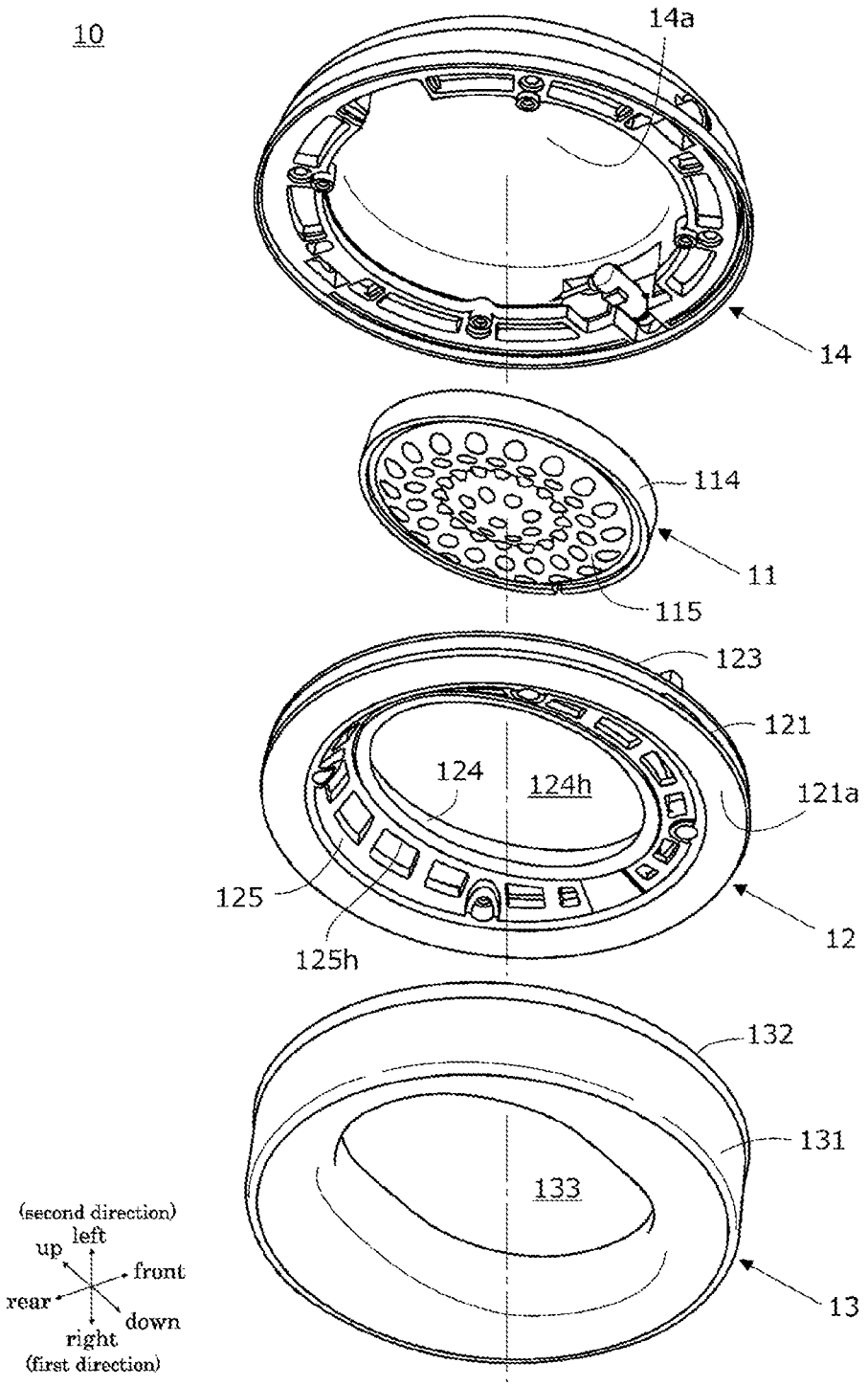
FIG. 5 is an exploded perspective view of the left sound emission unit in FIG. 2.

FIG. 5 is an exploded perspective view of the left sound emission unit 10.

The left sound emission unit 10 includes a driver unit 11, a baffle member 12, an ear pad 13, and a housing 14.

The driver unit 11 converts a sound signal into a sound wave and outputs the sound wave. The driver unit 11 is a dynamic-type driver unit that includes a diaphragm 111, a voice coil 112, a magnetic circuit 113, a case 114, and a protective plate 115.

The baffle member 12 holds the driver unit 11. The baffle member 12 defines the first space S1 and the second space S2. The configuration of the baffle member 12 will be described in more details below.

The "first space S1" is an acoustic space surrounded by the driver unit 11, the baffle member 12, the ear pad 13, and the temporal region HD in the worn state.

The "second space S2" is an acoustic space surrounded by the driver unit 11, the baffle member 12, and the housing 14. The volume of the first space S1 and the volume of the second space S2 affect the vibration of the diaphragm 111, that is, the characteristics of the headphone 1.

The ear pad 13 functions as a buffer between the baffle member 12 and the temporal region HD. The ear pad 13 includes a body part 131, a flap 132, and a mesh 133.

The body part 131 is a buffer between the baffle member 12 and the temporal region HD. The body part 131 has a ring shape, i.e., a doughnut shape. The body part 131 is deformed by the side pressure from the connection member 30 (see FIG. 1), and is in close contact with the temporal region HD. In the worn state, in order to increase a contact area of the body part 131 with the temporal region HD, the width of a part of the body part 131 disposed in front of and behind the ear (the front part and the rear part of the body part 131) is larger than the width of a part of the body part 131 disposed above and below the ear (an upper part and a lower part of the body part 131).

The body part 131 is constituted by covering the elastic material with a cover material, and has elasticity. The cover material is made of, for example, a material with a good texture such as leather. The elastic material is made of, for example, a resilient material such as urethane foam. A part of the cover material protrudes from the outer peripheral edge of the left surface of the body part 131 (the surface of the right side of the paper in FIGS. 3 and 4) to the inner peripheral side, constituting the flap 132. The flap 132 supports the body part 131 to the baffle member 12.

The mesh 133 prevents entry of sweat and foreign objects from the outside into the driver unit 11. The mesh 133 is made of, for example, a well-breathable chemical fiber. The mesh 133 is attached to the left surface of the body part 131 with a predetermined tension. The mesh 133 covers an opening on a side of the body part 131 in the second direction. The mesh 133 is a mesh member in the present invention.

The flap 132 is attached to the below-mentioned first flange part 121 of the baffle member 12. As a result, the body part 131 and the mesh 133 is disposed at a side in the first direction with respect to the baffle member 12.

The housing 14 accommodates the driver unit 11 to define a second space S2 on a side of the driver unit 11 in the second direction. The housing 14 is cup-shaped and has, for example, a gently curved bottom surface 14*a*. The housing 14 is made of, for example, a synthetic resin such as ABS. The bottom surface 14*a* is a covering surface in the present invention.

Note that the housing may be made of wood or metal, or may be composed of a composite member, for example, a member made of synthetic resin and a member made of wood.

Configuration of Baffle Member

Figure 6:
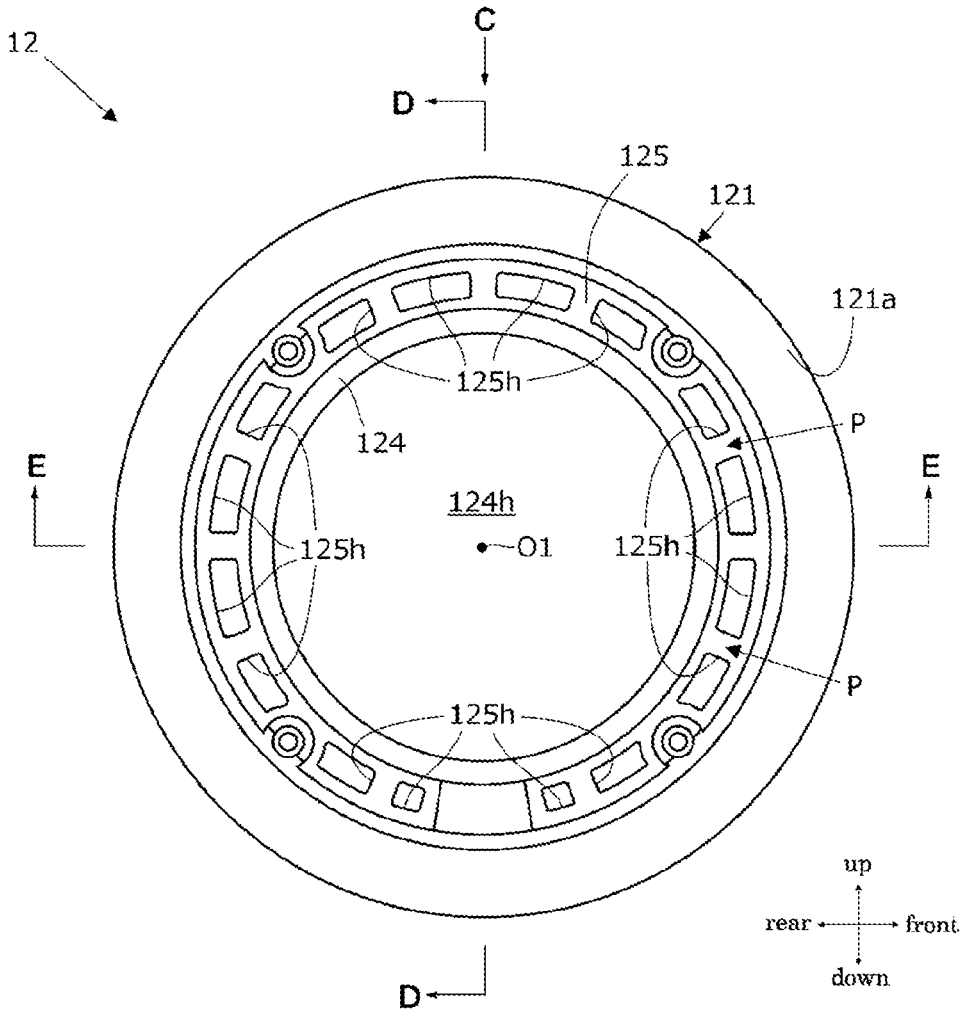
FIG. 6 is a side view of a baffle member included in the left sound emission unit in FIG. 2.

FIG. 6 is a side view of the baffle member 12 viewed from the right side of the baffle member 12.

Figure 7:
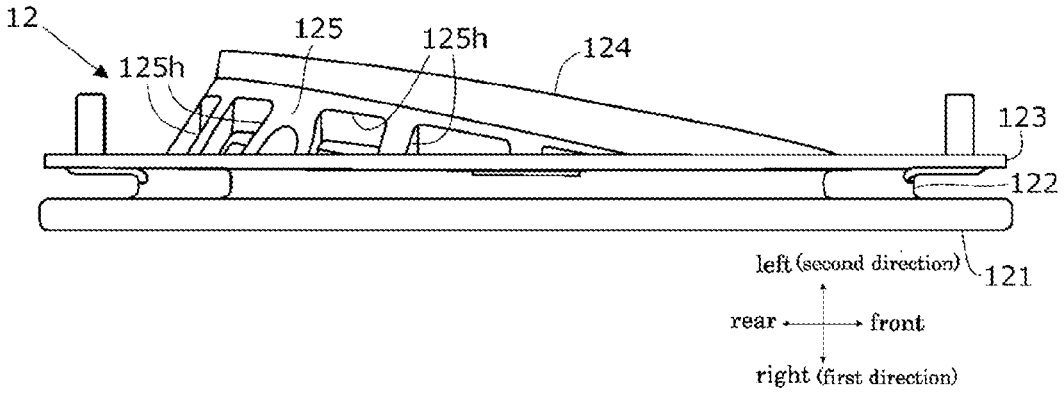
FIG. 7 is a diagram of the baffle member viewed along arrow C in FIG. 6.

FIG. 7 is a view of the baffle member 12 viewed along arrow C in FIG. 6.

Figure 8:
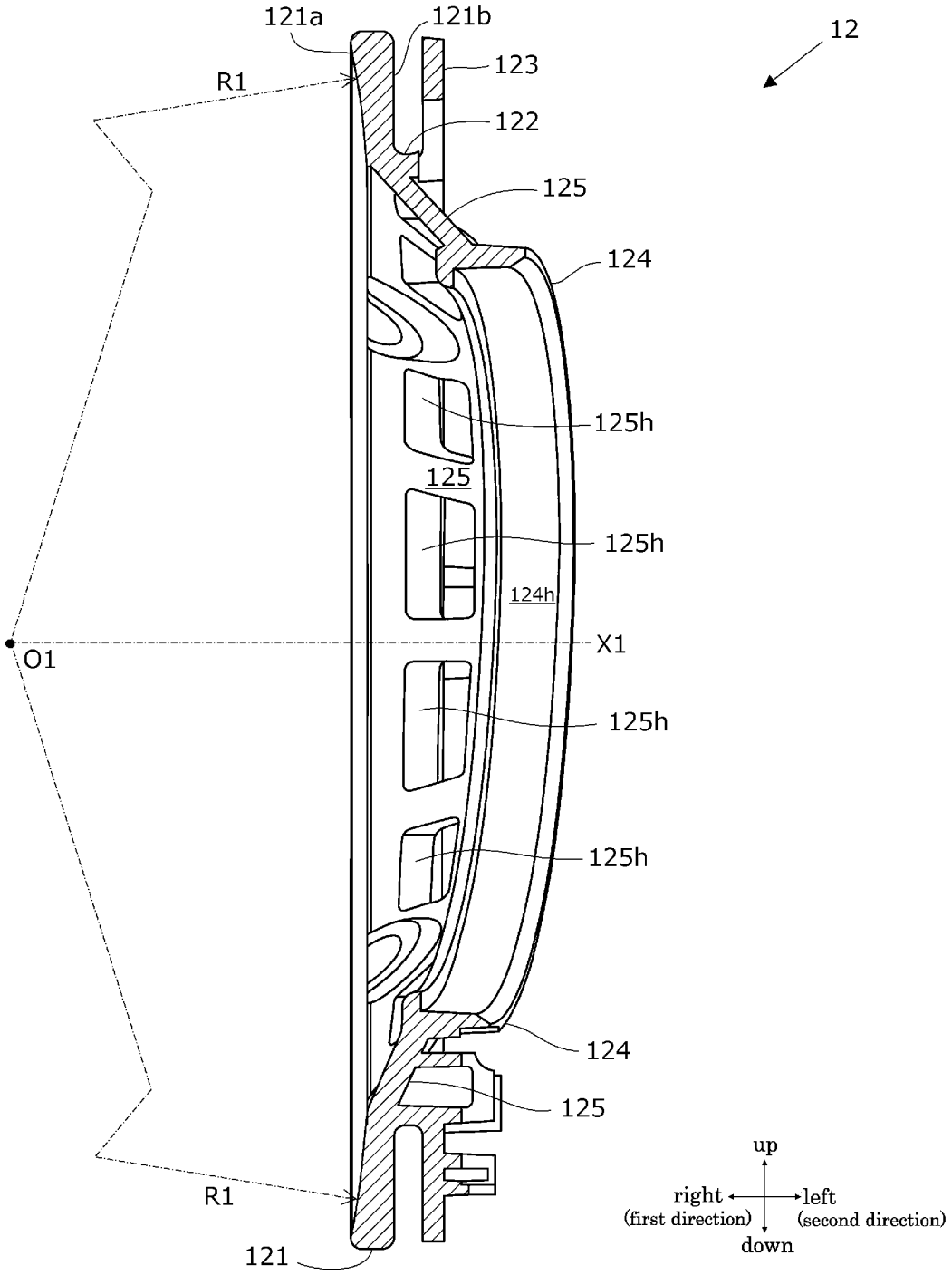
FIG. 8 is a cross-sectional view of the baffle member taken along line D-D in FIG. 6.

FIG. 8 is a cross-sectional view of the baffle member 12 taken along line D-D in FIG. 6.

Figure 9:
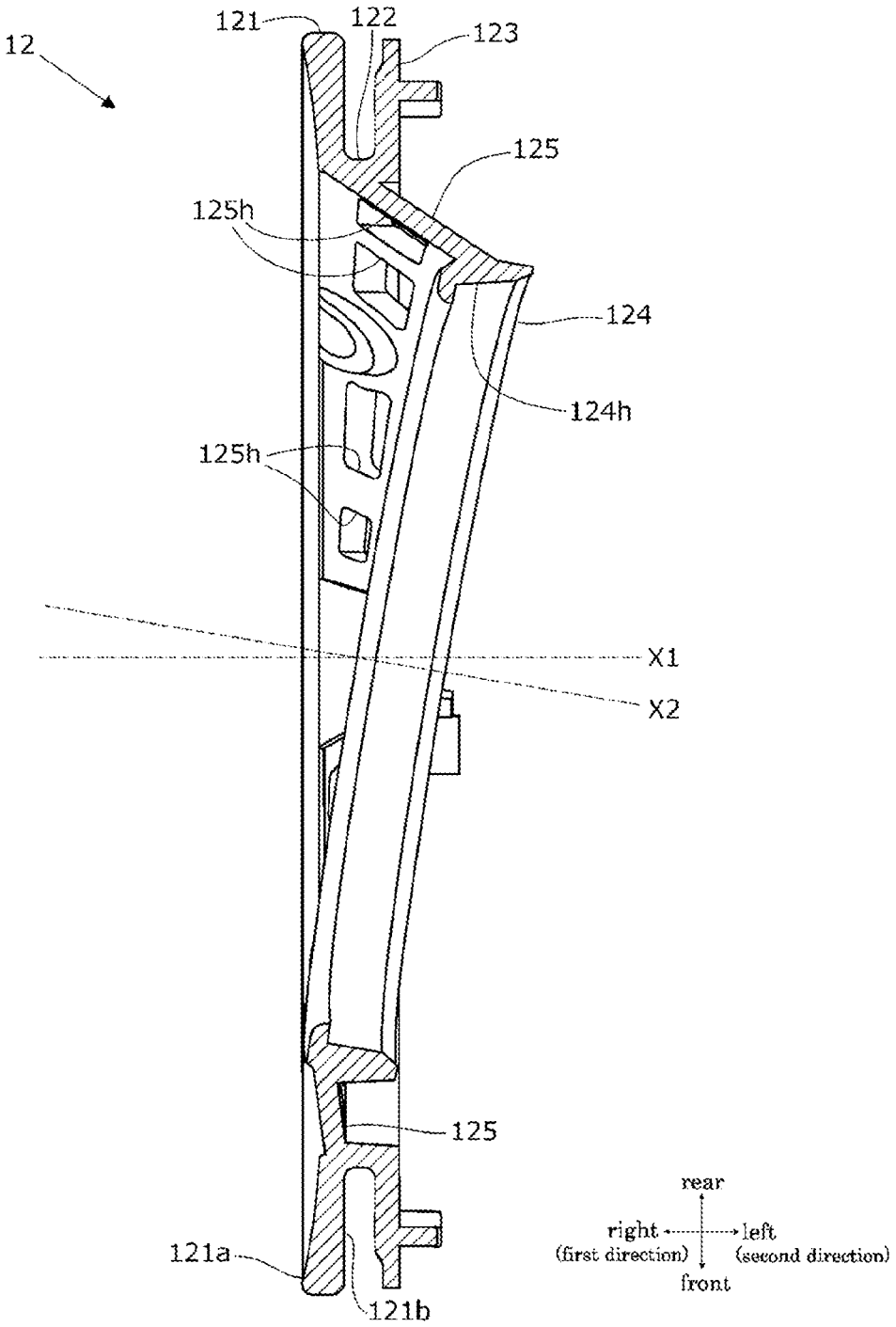
FIG. 9 is a cross-sectional view of the baffle member taken along line E-E in FIG. 6.

FIG. 9 is a cross-sectional view of the baffle member 12 taken along line E-E in FIG. 6.

The baffle member 12 has a circular shape in side view. The baffle member 12 is made of, for example, a synthetic resin such as ABS. The baffle member 12 includes a first flange part 121, a side surface part 122, a second flange part 123, a holding part 124, and an inclined part 125. Each of the first flange part 121, the side surface part 122, the second flange part 123, the holding part 124, and the inclined part 125 is integrally configured.

The first flange part 121 holds the ear pad 13 (see FIGS. 3 and 4). The first flange part 121 has a ring plate shape. The first flange part 121 is a flange part in the present invention. The first flange part 121 is disposed on the outer edge of the baffle member 12 in side view. The first flange part 121 includes a first surface 121*a* and a second surface 121*b*.

The first surface 121*a* is a surface on a side of the first flange part 121 in the first direction. The first surface 121*a* is a facing surface in the present invention. The first surface 121*a* is a curved surface that is curved to the second direction from the outer edge toward the inner edge over the entire circumference of the first surface 121*a*. In other words, the first surface 121*a* has a shallow cone shape.

In the present embodiment, the "curved surface that is curved to the second direction from the outer edge toward the inner edge", is a curved surface whose curvature center O1 is located on the side in the first direction, and the position of the outer edge is closer to the side in the first direction than that of the inner edge in the left-right direction.

The width of the first surface 121*a*, i.e., the distance between the outer edge and the inner edge, is uniform over the entire circumference of the first surface 121*a*.

In the present embodiment, as illustrated in FIG. 8, the first surface 121*a* is configured as a curved surface with curvature radius R1 having its center at the curvature center O1. The curvature center O1 is disposed at the side in the first direction with respect to the first surface 121*a* and on the central axis X1 of the baffle member 12. The "central axis X1" passes through the center of the baffle member 12 in side view, being a line parallel to the left-right direction. That is, the curvature radius R1 of the curved surface of the first surface 121*a* is uniform over the entire circumference of the first surface 121*a*.

The curvature radius R1 is set based on the shape of a part around the ear of an average person. That is, for example, the curvature radius R1 is set to a value smaller than the average value of the curvature radius of the part around the ear of the average person.

The second surface 121*b* is a surface at a side of the first flange part 121 in the second direction. The second surface 121*b* is a surface perpendicular to the central axis X1 of the baffle member 12. Thus, the first surface 121*a* is a surface that is curved to the second surface 121*b*.

The side part 122 is disposed between the first flange part 121 and the second flange part 123 to define a gap into which the flap 132 (see FIGS. 3 and 4) is inserted. The side surface part 122 has a ring shape. The side part 122 is disposed at the left side of the first flange part 121.

The second flange 123 has a ring plate shape. The second flange part 123 is parallel to the second surface 121*b*. The second flange part 123 is disposed at the left side of the side surface part 122.

The holding unit 124 holds the driver unit 11 (see FIGS. 3 and 4). The holding part 124 has a cylindrical shape. The holding part 124 has an opening 124*h* with a diameter smaller than that of the driver unit 11 at the center of the holding part 124. The position of holding part 124 is closer to the central side of the baffle member 12 than that of the first flange part 121 in side view. The holding part 124 is inclined to the second surface 121*b* along the auricle of the user in the worn state. That is, the central axis X2 of the holding part 124 is inclined obliquely forward with respect to the central axis X1 of the baffle member 12. As illustrated in FIG. 9, in the left-right direction, the position of the rear part of the holding part 124 is closer to a side in the left direction (the second direction) than that of the second flange part 123, and the position of the front part of the holding part 124 is slightly closer to a side in the right direction (the first direction) than that of the second flange part 123. That is, the rear part of the holding part 124 protrudes the most from the second flange part 123 to the side in second direction.

The inclined part 125 is disposed between the first flange part 121 and the holding part 124 in side view. The inclined part 125 has an annular band shape inclined to the second surface 121*b*.

The front part of the inclined part 125 is inclined to the first direction with respect to the second surface 121*b*. Parts other than the front part of the inclined part 125 is inclined to the second direction. That is, the inclination direction of the inclined part 125 changes from a certain position (change point P, see FIG. 6) in the circumferential direction of the inclined part 125. The inclination angle of the inclined part 125 to the second surface 121*b* increases toward the rear part from the change point P, and slightly increases toward the front part from the change point P. That is, the inclination angle continuously changes in the circumferential direction of the inclined part 125, being maximum at the rear part, and minimum at the change point P.

The width of the inclined part 125 (distance between the outer edge and the inner edge) changes in accordance with the inclination angle. That is, the width of the inclined part 125 continuously changes in the circumferential direction, being maximum at the rear part, and minimum at the change point P. In other words, the width of the inclined part 125 is maximum at the rear part, and minimum in the vicinity of the front part. As described above, the rear part of the holding part 124 protrudes the most from the second flange part 123 to the side in the second direction. Therefore, the rear part of the inclined part 125 also protrudes the most from the second flange part 123 to the side in the second direction.

The inclined part 125 includes a plurality of through holes 125*h* (16 through holes in this embodiment). As illustrated in FIG. 4, the through holes 125*h* connect the first space S1 and the second space S2. Each of the through holes 125*h* is disposed on the inclined part 125 at equal angular intervals along the circumferential direction of the inclined part 125.

An opening area of each of the through holes 125*h* increases as the width of the inclined part 125 increases. As described above, the width of the inclined part 125 changes in accordance with the inclination angle of the inclined part 125, being maximum at the rear part, and minimum in the vicinity of the front part. Therefore, the opening area is set to increase as the inclination angle of the inclined part 125 increases. Therefore, the opening area of the through hole 125*h* on the rear part is larger than the opening area of the through hole 125*h* on the front part.

The shape of each of the through holes 125*h* is set to be substantially the same in projection view (side view) from the first direction. "The shape is substantially the same" indicates that the shape is the same unless a structure (for example, a boss part or a jack of a cable) that inhibits the formation of each of the through hole 125*h* is disposed on the inclined part 125.

Referring back to FIGS. 3-5, the driver unit 11 is attached to the holding part 124 of the baffle member 12. Accordingly, the driver unit 11 is disposed at the side in the second direction with respect to the baffle member 12. As described above, the holding part 124 of the baffle member 12 is inclined to the second surface 121*b* of the baffle member 12. Thus, the driver unit 11 is also held to the holding part 124 in a state of being inclined to the second surface 121*b*.

The flap 132 of the ear pad 13 is inserted into the gap of the baffle member 12 so as to wrap the first flange part 121 of the baffle member 12. As a result, the ear pad 13 is attached to the baffle member 12. The body part 131 and the mesh 133 of the ear pad 13 are disposed at the side in the first direction with respect to the baffle member 12.

The mesh 133 is disposed between the baffle member 12 and the body part 131, and covers the right direction of the baffle member 12.

The first surface 121*a* of the first flange part 121 faces the body part 131 (via the mesh 133). In a state in which the headphone 1 is not worn by the user (an unworn state), the outer edge of the first surface 121*a* abuts the ear pad 13 (the mesh 133 or the body part 131). The inner edge part of the body part 131 is then lifted to the side in the first direction by the tension of the flap 132 with the outer edge of the first surface 121*a* as a fulcrum. Therefore, the inner edge of the first surface 121*a* is separated from (does not abut) the ear pad 13 (the body part 131 or the mesh 133). That is, in the unworn state, the distance between the body part 131 and the first surface 121*a* increases from the outer edge of the first surface 121*a* toward the inner edge. Specifically, in the unworn state, the distance between the body part 131 and the inner edge is greater than the distance between the body part 131 and the outer edge.

As described above, the widths of each of the front and rear parts of the body part 131 are greater than the widths of each of the top and bottom parts. Therefore, each of the front and rear parts of the body part 131 protrudes in the right direction of the inclined part 125 of the baffle member 12. That is, each of the top and bottom parts of the body part 131 faces the first surface 121*a* (via the mesh 133). Each of the front and rear parts of the body part 131 faces the first surface 121*a* and the inclined part 125 (via mesh 133).

The housing 14 is attached to the second flange part 123 of the baffle member 12 with a screw (not illustrated). The housing 14 is disposed at the side in the second direction with respect to the baffle member 12. The housing 14 covers a side of each of the driver unit 11 and the baffle member 12 in the second direction. That is, the bottom surface 14*a* of the housing 14 covers the side of the driver unit 11 in the second direction. As a result, the housing 14 defines a second space S2 together with the driver unit 11 and the baffle member 12.

As described above, the rear part of the holding part 124 protrudes the most from the second flange part 123 to the side in the second direction. Therefore, the rear part of the driver unit 11 is closest to the bottom surface 14*a* of the housing 14. As a result, when the diaphragm 111 vibrates, the rear part of the diaphragm 111 may be affected by internal pressure in the second space S2. The "internal pressure" is pressure (reaction force) received from the air in the second space S2 when the diaphragm 111 vibrates to push out the air into the second space S2. The speed of the vibration of the diaphragm 111 becomes slower as the frequency range becomes lower. When the diaphragm 111 vibrates in the low frequency range, the diaphragm 111 is displaced while slowly moving the air. That is, the diaphragm 111 pushes out more air into the second space S2 as the frequency range becomes lower. Therefore, the vibration of the diaphragm 111 is more strongly damped by the internal pressure as the frequency range becomes lower. As a result, when the distance between the diaphragm 111 and the bottom surface 14*a* is short, the vibration of the diaphragm 111 can be suppressed, particularly in the low frequency range.

Here, the distance between the bottom surface 14*a* and the through holes 125*h* decreases from the front part toward the rear part of the inclined part 125. The opening area of the through holes 125*h* on the rear part of the inclined part 125 is larger than the opening area of the through holes 125*h* on the front part of the inclined part 125. Therefore, the air in the rear part of the second space S2 is likely to move (flow) to the first space S1. As a result, the influence of the aforementioned internal pressure is eliminated. Thus, the diaphragm 111 can vibrate uniformly in the circumferential direction of the diaphragm 111 without being affected by the aforementioned internal pressure.

Configuration of Right Sound Emission Unit

Referring back to FIG. 1, the right sound emission unit 20 includes a driver unit (not illustrated), a baffle member 22, an ear pad 23, and a housing 24. The configuration of the right sound emission unit 20 is common to the configuration of the left sound emission unit 10. Therefore, a detailed description of the right sound emission unit 20 is omitted.

Deformation of Ear Pad

The deformation of the ear pad 13 when the headphone 1 is worn on the head of the user will now be described.

Figure 10:
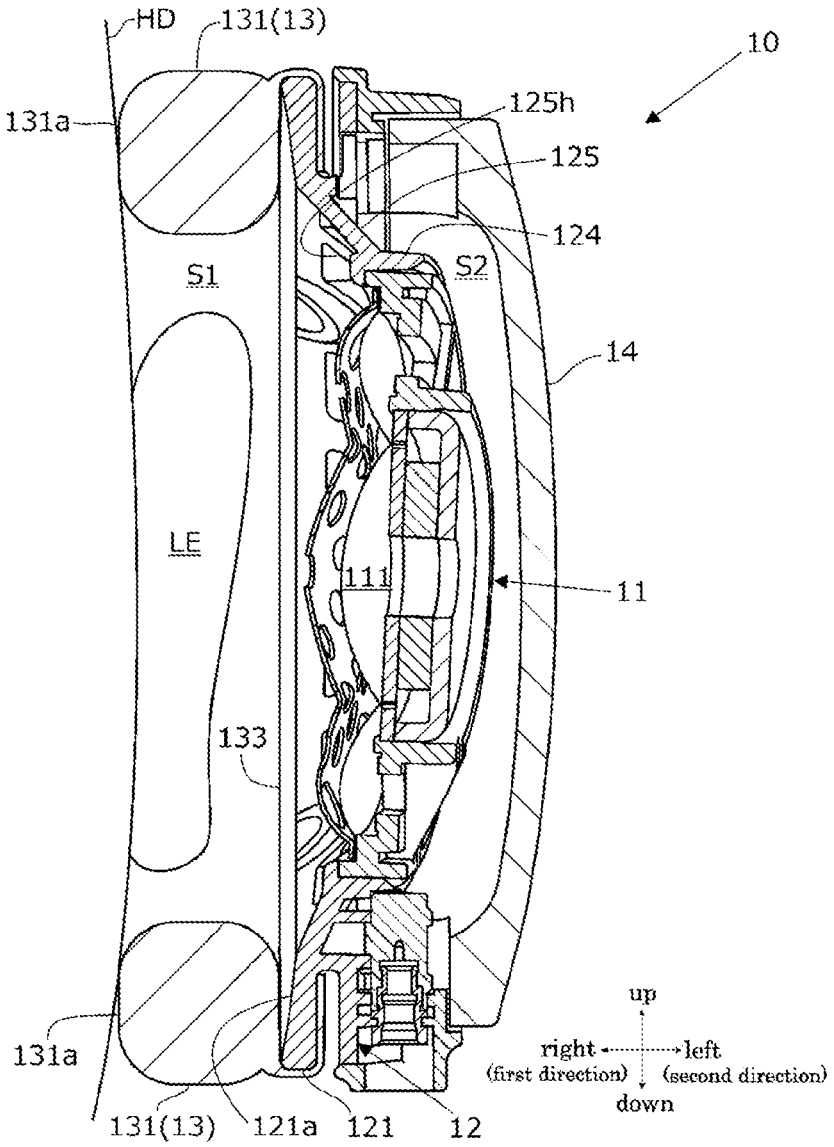
FIG. 10 is a cross-sectional view illustrating a state immediately before the headphone in FIG. 1 is worn by a user.

FIG. 10 is a cross-sectional view illustrating a state immediately before the headphone is worn on the head of the user taken along line A-A in FIG. 2.

For convenience of explanation, FIG. 10 schematically illustrates the temporal region HD and the left ear LE. FIG. 10 illustrates a state in which the body part 131 abuts the temporal region HD. FIG. 10 illustrates a state in which the side pressure from the connection member 30 (see FIG. 1, the same applies hereinafter) does not act on the baffle member 12 and the body part 131, because the user supports the left sound emission unit 10 with his/her hand, for example.

As illustrated in FIG. 10, in the state immediately before the headphone 1 is worn by the user (i.e., an unworn state), the baffle member 12 does not press the ear pad 13 (body part 131) against the temporal region HD. Therefore, the inner edge part of the body part 131 and the mesh 133 are separated from the first surface 121*a* of the baffle member 12.

When the side pressure from the connection member 30 acts on the baffle member 12, the outer edge of the first surface 121*a* presses the mesh 133 and the body part 131 toward the temporal region HD. The body part 131 then tilts toward a side of the first surface 121*a* (the side in the second direction) with the outer edge of the first surface 121*a* as a fulcrum. As described above, the curvature radius R1 of the first surface 121*a* (see FIG. 8) is set based on the shape of the temporal region HD around the ear of the user. Therefore, when the body part 131 tilts toward the first surface 121*a*, the right surface 131*a* (the surface on the side of the temporal region HD) of the body part 131 forms a concave surface (curved surface) along the shape of the temporal region HD. As a result, the most parts of the right surface 131*a* is uniformly in contact with the temporal region HD. The driver unit 11, the baffle member 12, the ear pad 13, and the temporal region HD then define a first space S1.

Figure 11:
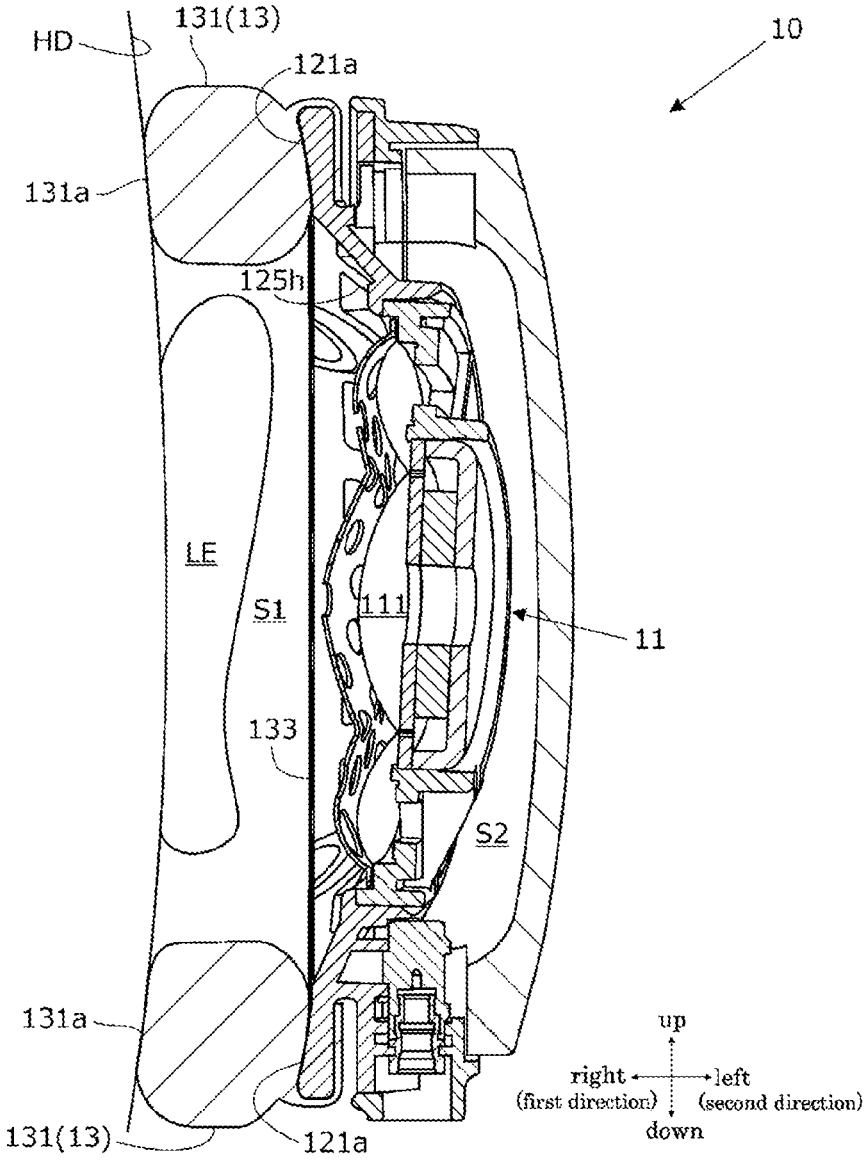
FIG. 11 is a cross-sectional view illustrating a state after the headphone in FIG. 10 is worn by the user.

FIG. 11 is a cross-sectional view of the left sound emission unit 10 in the worn state taken along line A-A in FIG. 2. For convenience of explanation, the drawing schematically illustrates the temporal region HD and the left ear LE of the user.

The first surface 121*a* presses the body part 131 toward the temporal region HD via the mesh 133. The body part 131 then deforms substantially equally to the inner edge side and the outer edge side along the shapes of the temporal region HD and the first surface 121*a*. As a result, the body part 131 deforms along the shape of the temporal region HD, and comes into close contact with the temporal region HD.

As a result of the body part 131 tilting toward the first surface 121*a*, the mesh 133 abuts the first surface 121*a* in order from the outer edge to the inner edge of the first surface 121*a*. The mesh 133 is then slightly expanded by the body part 131. As a result, the tension acting on the mesh 133 slightly increases.

In this manner, in a state in which the most parts of the right surface 131*a* of the body part 131 are in contact with the temporal region HD, the body part 131 deforms along the temporal region HD to be in close contact with the temporal region HD. Therefore, the body part 131 is pressed against the temporal region HD with a uniform pressure over the entire circumference. Accordingly, the close contact property between the ear pad 13 and the temporal region HD is improved, and the wearability of the headphone 1 to the user is also improved. In addition, the first space S1 is shielded from the external space of the headphone 1, and the airtightness of the first space S1 is ensured.

Figure 12:
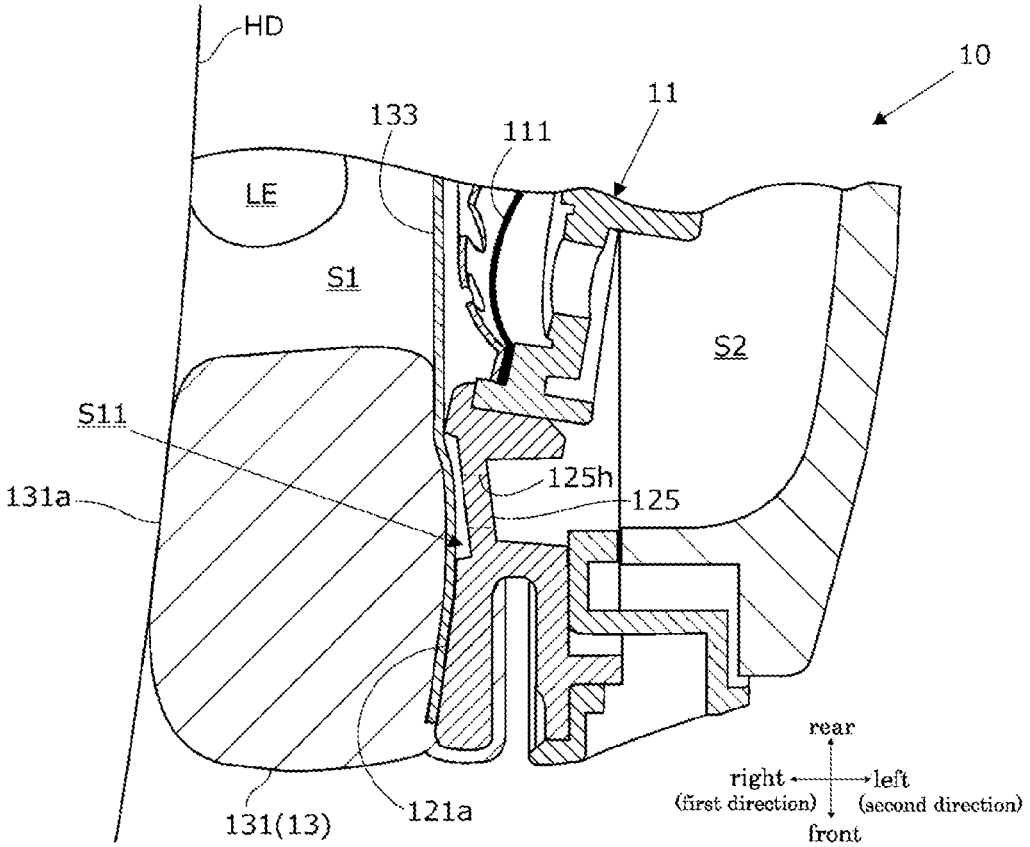
FIG. 12 is an enlarged cross-sectional view illustrating the state in FIG. 11 viewed from another angle.

FIG. 12 is an enlarged cross-sectional view of the left sound emission unit 10 in the worn state taken along line B-B in FIG. 2. FIG. 12 illustrates an enlarged cross section of the front part of the left sound emission unit 10.

As described above, the front part of the ear pad 13 faces the inclined part 125. The front part of the inclined part 125 is inclined to the first direction, and the inclination angle of the front part is small. Therefore, in the worn state, the front part of the body part 131 is tilted and deforms to the side in the second direction so as to cover the front part of the inclined part 125. The mesh 133 is then interposed between the body part 131 and the front parts of the first surface 121*a* and the inclined part 125. As described above, the tension of the mesh 133 increases slightly. Therefore, the mesh 133 prevents the deformation of the body part 131 to a side of the inclined part 125. As a result, in the worn state, a gap S11 is defined between the front part of the inclined part 125 and the mesh 133. That is, the through hole 125*h* disposed on the front part of the inclined part 125 is not closed by the body part 131. The gap S11 increases from the front part toward the rear part of the inclined part 125 in the circumferential direction of the inclined part 125, constituting a part of the first space S1. In other words, the gap S11 is defined over the entire circumference of the inclined part 125. As a result, in the worn state, the ventilation between the first space S1 and the second space S2 is ensured over the entire circumference of the inclined part 125.

As described above, the through holes 125*h* are disposed at equal angular intervals, and the shapes of the through holes 125*h* are substantially the same in side view. That is, the through holes 125*h* are uniformly disposed to surround the driver unit 11. Therefore, the ventilation between the first space S1 and the second space S2 is made substantially uniform on the entire circumference of the driver unit 11. As a result, the diaphragm 111 can vibrate substantially uniformly in the circumferential direction of the diaphragm 111.

CONCLUSION

According to the embodiment described above, the first surface 121*a* of the baffle member 12 is configured as a curved surface that is curved to the second direction from the outer edge toward the inner edge. Therefore, when the user wears the headphone 1, the body part 131 of the ear pad 13 is inclined to the second direction. As a result, the right surface of the body part 131 can be uniformly in close contact with the temporal region HD of the user. In this manner, the headphone 1 improves the close contact property of the ear pad 13 to the temporal region HD by devising the shape of the first surface 121*a* of the baffle member 12. That is, the headphone 1 requires no special devises on the ear pad 13. Therefore, in the headphone 1, the cost required for the ear pad 13 is reduced as compared with a conventional headphone using an ear pad in which a plurality of materials are combined (hereinafter referred to as "conventional headphone"). That is, the headphone 1 can easily improve the close contact property between the ear pad 13 and the temporal region HD at low cost as compared with conventional headphone.

Further, as described above, when the user wears the headphone 1, the body part 131 tilts toward the first surface 121*a*, so that the most parts of the right surface 131*a* of the body part 131 comes into close contact with the temporal region HD uniformly. Therefore, in the headphone 1, the close contact property between the ear pad 13 and the temporal region HD is ensured without excessive deformation of the body part 131. As a result, in the headphone 1, the volume of the first space S1 is ensured without the configuration of excessively thickening the ear pads 13.

Further, according to the embodiment described above, the curvature radius R1 of the first surface 121*a* is set based on the shape of the part around the ear of the average person. Therefore, when the body part 131 tilts toward a side in the second direction, the right surface 131*a* of the body part 131 is curved along the shape of the temporal region HD to be in contact with the temporal region HD. As a result, the headphone 1 can easily improve the close contact property between the ear pad 13 and the temporal region HD.

Furthermore, according to the embodiment described above, in the unworn state, the outer edge of the first surface 121*a* abuts the ear pad 13 (the body part 131 or the mesh 133), and the inner edge of the first surface 121*a* does not abut the ear pad 13. That is, the distance between the body part 131 and the inner edge is greater than the distance between the body part 131 and the outer edge. Therefore, when the user wears the headphone 1, the body part 131 is likely to tilt toward a side in the first surface 121*a* (the side in the second direction).

Furthermore, according to the embodiment described above, the second surface 121*b* of the first flange part 121 is a surface perpendicular to the central axis X1 of the baffle member 12. The first surface 121*a* is a curved surface that is curved to the second surface 121*b*. Therefore, the headphone 1 can easily improve the close contact property between the ear pad 13 and the temporal region HD while securely holding the body part 131 with the second surface 121*b* and the flap 132.

Furthermore, according to the embodiment described above, the inclined part 125 is inclined to the second surface 121*b*, and the inclination angle is continuously changed in the circumferential direction of the inclined part 125. That is, the inclined part 125 does not have a bent or stepped part in the entire circumference. Therefore, the sound waves emitted into each of the first space S1 and the second space S2 are not irregularly reflected at the surface of the inclined part 125. As a result, in each of the frequency characteristics of the first space S1 and the second space S2, unnecessary resonance point is less likely to occur. Further, since a part of the first space S1 is also defined in the baffle member 12 by the inclined part 125, the volume of the first space S1 is sufficiently ensured.

Further, according to the embodiment described above, the holding part 124 is inclined to the second surface 121*b* along the auricle of the user. A part of the inclined part 125 (front part) is inclined to the first direction with respect to the second surface 121*b*. As a result, the headphone 1 enables that the baffle member 12 includes the driver unit 11 with a diameter as large as possible, while suppressing an increase in thickness in the left-right direction. Further, the volume of the first space S1 is sufficiently ensured since the inclined part 125 is formed in accordance with the inclination of the holding part 124.

Further, according to the embodiment described above, the inclined part 125 includes a plurality of through holes 125*h* disposed along the circumferential direction of the inclined part 125. That is, the through holes 125*h* are disposed on the inclined part 125 served as the inclined surface. In other words, the through holes 125*h* are three-dimensionally disposed on the baffle member 12. As a result, in the headphone 1, the ventilation between the first space S1 and the second space S2 is ensured, even if the driver unit 11 with a large diameter is attached to the baffle member 12.

Further, according to the embodiment described above, the shape of each of the through holes 125*h* is substantially the same in projection view from the first direction. Therefore, the ventilation between the first space S1 and the second space S2 is made substantially uniform on the entire circumference of the driver unit 11. As a result, the diaphragm 111 can vibrate substantially uniformly in the circumferential direction of the diaphragm 111.

Furthermore, according to the embodiment described above, the opening area of each of the through holes 125*h* increases as the inclination angle of the inclined part 125 increases. The distance between the bottom surface 14*a* of the housing 14 and each of the through hole 125*h* decreases as the inclination angle of the inclined part 125 increases. As a result, the influence of the internal pressure on the diaphragm 111 at the rear part of the second space S2, which may occur by tilting the rear part of the driver unit 11 toward the side in the second direction, is eliminated. Therefore, the diaphragm 111 can vibrate substantially uniformly in the circumferential direction of the diaphragm 111 without being affected by the internal pressure.

Furthermore, according to the embodiment described above, in the worn state, the gap S11 is defined between the mesh 133 and the inclined part 125. The gap S11 is defined over the entire circumference of the inclined part 125. Therefore, the through holes 125*h* are not closed by the body part 131. The gap S11 increases from the front part toward the rear part of the inclined part 125, constituting a part of the first space S1. As a result, in the worn state, the ventilation between the first space S1 and the second space S2 is ensured over the entire circumference of the inclined part 125.

In the embodiment described above, the curvature radius R1 of the first surface 121*a* is the same over the entire circumference. Alternatively, the curvature radius of a part of the first surface may be different from the curvature radius of another part of the first surface. That is, the curvature radius of the first surface may be different for each region in accordance with the shape of the temporal region. Specifically, the facing surface has at least a first part and a second part. The first part includes a first curved surface with a first curvature radius. The second part includes a second curved surface with a second curvature radius. The first curvature radius of the first curved surface of the first part is different from the second curvature radius of the second curved surface of the second part. In general, in the temporal region around ear, the posterior and inferior shape of ear are more curved than the anterior and superior shape of ear. Therefore, for example, the first curvature radius of the facing surface may be smaller than the second curvature radius of the facing surface. Thus, the first part is disposed behind or below the ear and the second part is disposed in front or above the ear, when the headphone is worn by the user. In this manner, since the first surface has a plurality of radii of curvature along the shape of the temporal region, the close contact property between the ear pad and the temporal region is further improved.

In the embodiment described above, the curved surface is disposed over the entire circumference of the first surface 121*a*. Alternatively, a part of the first surface may be non-curved plane surface. In other words, at least a part of the first surface may be curved toward the second direction, and another part may be plane.

Further, in the embodiment described above, the first surface 121*a* is a curved surface that is curved to the second direction from the outer edge toward the inner edge. Alternatively, the first surface may be an inclined surface inclined to the second direction from the outer edge toward the inner edge of the first surface. In this case, the inclined surface may be disposed over the entire circumference of the first surface, or may be disposed on a part of the first surface (a part may be the non-inclined plane surface). In this configuration, "the inclination angle of the first surface" means, for example, the inclination angle of the first surface to the second direction, or the inclination angle of the first surface to the second surface. The inclination angle of the first surface is set based on the shape of the part around the user's ear as well as the curvature radius of the first surface. Therefore, the inclination angle of the first surface may be uniform over the entire circumference of the first surface. Alternatively, the angle of inclination of a part of the first surface may be different from the angle of inclination of another part of the first surface. Specifically, the facing surface has at least a first part and a second part. The first part includes a first inclined surface with a first inclination angle. The second part includes a second inclined surface with a second inclination angle. The first inclination angle of the first inclined surface of the first part is different from the second inclination angle of the second inclined surface of the second part. According to this configuration, when the user wears the headphone, the body part can tilt toward the side of the first surface (the side in the second direction) and can be in close contact with the temporal region of the user, similarly to the case where the first surface is a curved surface.

Furthermore, in the embodiment described above, the width of the first surface 121*a* (the distance between the outer edge and the inner edge) is uniform over the entire circumference of the first surface 121*a*. Alternatively, the width of the first surface may not be uniform. That is, for example, the width of a part of the first surface may be different from the width of another part of the first surface. Specifically, the width of the first surface may be adjusted to the width of the body part (the distance between the outer edge and the inner edge of the body part). That is, for example, the width of each of the front and rear parts of the first surface may be larger than the width of each of the top and bottom parts of the first surface.

Furthermore, the first surface may include a recessed part recessed toward the side in the second direction. That is, for example, the first surface may include a groove along the circumferential direction of the first surface. According to this configuration, when the baffle member is formed, generation of shrinkage (cavity) on the first surface is suppressed. Therefore, the formation accuracy of the first surface is improved. As a result, in the worn state, no irregularity in the tilting state of the body part toward the side in the first surface is generated, and the body part can be uniformly in contact with the temporal region. In addition, the weight of the baffle member is reduced.

Furthermore, the ear pad may not include the mesh.

Furthermore, the aspect of the inclined part is not limited to the present embodiment. That is, for example, the inclined part may be inclined toward the side in the second direction over the entire circumference. Further, for example, the inclination angle of the inclined part may not change continuously in the circumferential direction of the inclined part. That is, for example, the inclination angle of the inclined part may be changed intermittently in some parts.

Furthermore, the holding part may not be tilted along the auricle of the user. That is, for example, the holding part may be disposed perpendicular to the axial direction of the baffle member (parallel to the second surface).

Furthermore, some or all of the inclined parts may not be inclined to the second surface. That is, for example, the inclined part may be constituted by a cylindrical peripheral wall surface and a ring-shaped bottom surface. In this configuration, the peripheral wall surface is perpendicular to the second surface, and the bottom surface is parallel to the second surface. Further, for example, the first flange part and the inclined part may be formed in a continuous plate shape. In this configuration, the inclined part is parallel to the second surface.

Furthermore, the second surface of the first flange part of the baffle member may not be a plane surface perpendicular to the central axis of the baffle member. That is, for example, the second surface may be inclined to the central axis. In this case, the surface serving as a reference of inclination and curvature of the first surface may be a virtual surface perpendicular to the central axis, instead of the second surface.

Furthermore, in the embodiment described above, the headphone 1 is a closed type headphone. Alternatively, the headphone may be an open type headphone.

Furthermore, in the embodiment described above, the present invention is applied to the headphone 1. Alternatively, the present invention may be applied to an earmuff with no driver units. The earmuff may include, for example, a housing, a baffle member that holds the housing, and an ear pad that is attached to the baffle member. The baffle member includes a facing surface that faces the body part of the ear pad. In this configuration, at least a part of the facing surface is the inclined surface inclined to the second direction from the outer edge of the facing surface toward the inner edge of the facing surface or a curved surface that is curved to the second direction from the outer edge of the facing surface toward the inner edge of the facing surface. According to this configuration, the earmuff according to the present invention easily improves the close contact property between the ear pad and the temporal region at low cost, and has high sound insulation.

The invention claimed is:

1. A headphone comprising:

a driver unit;

a baffle member that holds the driver unit;

an ear pad that is attached to the baffle member; and a housing that is attached to the baffle member and accommodates the driver unit, wherein the ear pad includes a ring-shaped body part with a first outer edge, the baffle member includes a second outer edge and a facing surface that faces the body part of the ear pad, the first and second outer edges are adjacent to one another, a direction in which the body part is disposed with respect to the baffle member is a first direction, a direction in which the housing is disposed with respect to the baffle member is a second direction, at least a part of the facing surface is an inclined surface that is inclined to the second direction from the second outer edge of the baffle member toward an inner edge of the facing surface or a curved surface that is curved to the second direction from the second outer edge of the baffle member toward the inner edge of the facing surface.

2. The headphone according to claim 1, wherein the inclined surface or the curved surface is disposed over the entire circumference of the facing surface.

3. The headphone according to claim 2, wherein an inclination angle of the inclined surface or a curvature radius of the curved surface is uniform over the entire circumference of the facing surface.

4. The headphone according to claim 1, wherein the facing surface has at least a first part and a second part, the first part includes a first inclined surface with a first inclination angle or a first curved surface with a first curvature radius, the second part includes a second inclined surface with a second inclination angle or a second curved surface with a second curvature radius, the first inclination angle of the first inclined surface or the first curvature radius of the first curved surface of the first part is different from the second inclination angle of the second inclined surface or the second curvature radius of the second curved surface of the second part.

5. The headphone according to claim 3, wherein the inclination angle or the curvature radius of the facing surface is set based on a shape of a part around an ear of a person.

6. The headphone according to claim 4, wherein the first part is disposed behind an ear when the headphone is worn by a user, the second part is disposed in front of the ear when the headphone is worn by the user, the first inclination angle of the facing surface is greater than the second inclination angle of the facing surface, or the first curvature radius of the facing surface is less than the second curvature radius of the facing surface.

7. The headphone according to claim 1, wherein a distance between the body part and the inner edge of the facing surface is greater than a distance between the body part and the second outer edge when the headphone is not worn by a user.

8. The headphone according to claim 7, wherein the second outer edge abuts the first outer edge of the ear pad and the inner edge of the facing surface does not abut the ear pad.

9. The headphone according to claim 1, wherein a distance between the second outer edge and the inner edge of a part of the facing surface is different from a distance between the second outer edge and the inner edge of another part of the facing surface.

10. The headphone according to claim 1, wherein the baffle member includes a flange part that is disposed on an outer edge part of the baffle member, the flange part includes:

a first surface that is a surface on a side in the first direction; and a second surface that is a surface on a side in the second direction, wherein the first surface is the facing surface, and the facing surface is inclined or curved to the second surface.

11. The headphone according to claim 10, wherein the baffle member includes:

a holding part that holds the driver unit; and an inclined part that is disposed between the holding part and the facing surface, wherein the inclined part is inclined to the second surface.

12. The headphone according to claim 11, wherein an inclination angle of the inclined part to the second surface continuously changes in a circumferential direction of the inclined part.

13. The headphone according to claim 11, wherein when the headphone is worn by a user, the holding part is inclined to the second surface along an auricle of the user.

14. The headphone according to claim 11, wherein a part of the inclined part is inclined toward the first direction with respect to the second surface.

15. A headphone comprising:

a driver unit;

a baffle member that holds the driver unit;

an ear pad that is attached to the baffle member; and a housing that is attached to the baffle member and accommodates the driver unit, wherein the ear pad includes a ring-shaped body part, the baffle member includes a facing surface that faces the body part, a flange part that is disposed on an outer edge part of the baffle member, a holding part that holds the driver unit, and an inclined part that is disposed between the holding part and the facing surface, a direction in which the body part is disposed with respect to the baffle member is a first direction, a direction in which the housing is disposed with respect to the baffle member is a second direction, at least a part of the facing surface is an inclined surface that is inclined to the second direction from an outer edge of the facing surface toward an inner edge of the facing surface or a curved surface that is curved to the second direction from an outer edge of the facing surface toward an inner edge of the facing surface, the flange part includes a first surface that is a surface on a side in the first direction, and a second surface that is a surface on a side in the second direction, the first surface is the facing surface, the facing surface is inclined or curved to the second surface, the inclined part is inclined to the second surface, an inclination angle of the inclined part to the second surface continuously changes in a circumferential direction of the inclined part, the inclined part includes a plurality of through holes that communicate a space at a side of the driver unit in the first direction with a space at a side of the driver unit in the second direction, and each of the through holes is disposed along the circumferential direction of the inclined part.

16. The headphone according to claim 15, wherein a shape of each of the through holes is substantially the same in projection view from the first direction.

17. The headphone according to claim 15, wherein an opening area of each of the through holes increases as the inclination angle of the inclined part increases.

18. The headphone according to claim 15, wherein the housing includes a covering surface that covers a side of the driver unit in the second direction, and a distance between the covering surface and each of the through holes decreases as the inclination angle of the inclined part increases.

19. The headphone according to claim 15, wherein the ear pad includes a mesh member that covers an opening of the body part on a side in the second direction, and a gap is defined between the mesh member and the inclined part when the headphone is worn by a user.

20. The headphone according to claim 19, wherein the gap is formed over the entire circumference of the inclined part.

21. An ear muff comprising:

a baffle member;

an ear pad that is attached to the baffle member; and a housing that is attached to the baffle member, wherein the ear pad includes a ring-shaped body part with a first outer edge, the baffle member includes a second outer edge and a facing surface that faces the body part of the ear pad, the first and second outer edges are adjacent to one another, a direction in which the body part is disposed with respect to the baffle member is a first direction, a direction in which the housing is disposed with respect to the baffle member is a second direction, at least a part of the facing surface is an inclined surface which is inclined to the second direction from the second outer edge of the baffle member toward an inner edge of the facing surface or a curved surface that is curved to the second direction from the second outer edge of the baffle member toward the inner edge of the facing surface.

* * * * *